US006012752A

United States Patent [19]

Douglas

[11] Patent Number: 6,012,752

[45] Date of Patent: Jan. 11, 2000

[54] CONCRETE PIPE LIFTING APPARATUS

[76] Inventor: William E. Douglas, Rd No. 1 Box 151A, New Florence, Pa. 15944

[21] Appl. No.: 09/256,772

[22] Filed: Feb. 24, 1999

[51] Int. Cl.[7] ..... B66C 1/42

[52] U.S. Cl. ..... 294/110.1; 294/117; 294/119

[58] Field of Search ..... 294/106, 110.1, 294/117, 118, 119; 414/626

[56] References Cited

U.S. PATENT DOCUMENTS

| | | | |
|---|---|---|---|
| 748,222 | 12/1903 | Sites | 294/110.1 |
| 1,877,974 | 9/1932 | Robb . | |
| 2,286,071 | 6/1942 | Dragan et al. | 294/110.1 X |
| 2,378,570 | 6/1945 | Mitchell | 294/110.1 |
| 2,384,396 | 9/1945 | Peyer | 294/110.1 |
| 2,745,695 | 5/1956 | Peyer | 294/110.1 X |
| 3,008,753 | 11/1961 | Tazioli . | |
| 3,697,118 | 10/1972 | Johnstone et al. | 294/110.1 |
| 3,897,969 | 8/1975 | Dike . | |
| 4,030,625 | 6/1977 | Koehnen . | |
| 4,262,952 | 4/1981 | Bradley | 294/110.1 X |
| 5,056,845 | 10/1991 | Cook . | |
| 5,364,147 | 11/1994 | Dickey et al. . | |
| 5,666,758 | 9/1997 | Vaillier et al. . | |

FOREIGN PATENT DOCUMENTS

| | | |
|---|---|---|
| 1185260 | 7/1959 | France . |
| 354564 | 7/1961 | Switzerland . |

*Primary Examiner*—Johnny D. Cherry
*Attorney, Agent, or Firm*—Richard C. Litman

[57] ABSTRACT

A pipe lifter with lockable and releasable scissors grip structure, for laying large pipes. The apparatus includes a solid stabilizing plate over cooperating tongs, the base of the plate being capable of rotating about an axis parallel to the central axis of the pipe. The pipe lifter has reinforced linkage members, and multiple ribs between tong pairs, as well as multiple sets of cooperating tong pairs; thus the lifter is capable of withstanding tremendous torsional forces while safely navigating the piping into even very narrow trenches. The device includes a one-piece handle/latch assembly that a helper may operate safely, i.e., while maintaining a distance from any potential pinch points.

15 Claims, 6 Drawing Sheets

CONCRETE PIPE LIFTING APPARATUS

BACKGROUND OF THE INVENTION

1. Field of the Invention

The present invention relates generally to an apparatus for laying and lifting large precast concrete pipes for use in sewers and water mains. More specifically, the invention is a lockable and releasable scissors grip apparatus for laying large pipes.

2. Description of the Related Art

In the construction industry, it becomes necessary to lift and move large segments of pipe which are often precast concrete and weigh many tons. Some of the requirements that exist with respect to such pipe handling by lifting apparatus for moving heavy metal or concrete pipes include: stability, strength, resistance to torsion forces, rotational versatility, and safe ergonomic handling by workers. A number of different jaw or tong-type apparatus designed for suspension from a crane have been employed to fulfill these requirements, but such relevant art apparatus has had limited success in at least one or more respects. Each apparatus utilizes the common principle of the construction tong, i.e., the clamping force upon the pipe increases with its weight. The relevant art of interest will be described in the order of perceived relevance to the present invention.

U.S. Pat. No. 3,008,753 issued on Nov. 14, 1961, to Geno Tazioli describes a pair of pipe tongs with their pivot points connected by a single stabilizer. The tong handles are connected by a pair of pivot link bars to the ends of a hollow horizontal frame which houses the release mechanism for the tongs by attaching a spring to each pivot point. A cable is attached to each spring and attached to a ratchet and ratchet lock device with a release mechanism located in the center of the hollow housing. The release mechanism of this device is distinguishable for its different structure involving cables and springs.

U.S. Pat. No. 1,877,974 issued on Sep. 20, 1932, to John F. Robb describes a pipe line depositing machine operated with an endless track tractor having an extension from the side of a track to attach by a shoe to the pipe. The boom supports a pair of roller connected tongs (FIG. 6) or a single tongs (FIG. 1) by link members to a hook with a cable extending from the tongs to shoe. The tongs are released by a lever (at the pivot point) and cable attached to the tractor. The apparatus is distinguishable for its required connections to a tractor and the cabled release mechanism.

U.S. Pat. No. 3,897,969 issued on Aug. 5, 1975, to Clarence L. Dike describes a grapple for hoisting pipes. In FIG. 6, a pipe is carried by a spreader I-beam from which hang two grapples from chains. The flat grapple arms have an extension consisting of an upstanding flange and a perpendicular horizontal flange having a cushion. Each grapple has a leverage device and a safety device. The safety device has a wire rope attached to the outsides of the two upstanding flanges and linked by another wire rope to the grapple chains. If the chain breaks, the wire ropes will still hold the pipe. The leverage device is utilized to open the jaws and has an opening cable. The grapple system is distinguishable for its multiple cable (wire rope) usage for keeping the jaws open or closed.

France Patent Application No. 1,185,260 published on Jul. 31, 1959, for M. Marcel Tranchard describes a tongs with arcuate flanges on the inside surfaces of the jaws. A movable hook appears on one of the uppermost arms apparently for locking onto a pin on a lower arm of the tongs. The tongs with the locking mechanism is distinguishable for its purpose which apparently is to keep the jaws open and lacks any mechanism for its release.

U.S. Pat. No. 5,364,147 issued on Nov. 15, 1994, to Thomas E. Dickey et al. describes a device for handling a plurality of railroad timbers having a square cross-section. In FIG. 9, two pairs of inner actuating levers are held by chains to a hoisting hook. The levers are held together by a system of crossbars. Each lever has its bottom end bolted to the outside railroad tie. Two steel strapping members hold the ties together. The device is distinguishable for its fixed position of the jaws.

Switzerland Patent Application No. 354,564 published on Jul. 15, 1961, for Sergio Verdini describes a scissors clamp having crossbars at the ends of each jaw and an adjustable crossbar between the two arms of the jaws. The apparatus is distinguishable for its fixed jaws relationship.

U.S. Pat. No. 4,030,625 issued on Jun. 21, 1977, to Edward L. Koehnen describes a loader attachment for a tractor for handling logs, bales and the like. A scissors acting pair of hooks are connected by a horizontal pivot bar. The upper arms of the hooks are connected by links to a lifting strap which rides on hook control crank arm from a pulley. The crank arm is controlled by a control rod attached to a lever on the tractor. The apparatus is distinguishable for its weak structure.

U.S. Pat. No. 5,666,758 issued on Sep. 16, 1997, to George L. Vaillier et al. describes a retrieval mechanism for retrieving small articles comprising a scissors mechanism with cross members at the ends of the jaws perpendicular to the jaws and having a plurality of teeth facing inward. The links to the jaws are connected to a plate having two wire loops for containing a fishing line while retrieving a lure. The retrieval mechanism device is distinguishable for its limited use.

U.S. Pat. No. 5,056,845 issued on Oct. 15, 1991, to Carol A. Cook describes a concrete highway divider lifting apparatus with scissors actuated jaws having extended flattened surfaces of various types. An adjustable crossbar between the upper arms of the jaws maintains a fixed grip on the carried object. The apparatus is distinguishable for its fixed jaws.

However, it should be noted that other than having the common trait of utilizing the tong principle, the relevant art does not have the elements necessary to fulfill the requirements or the capabilities of the present inventive lifting apparatus.

None of the above inventions and patents, taken either singularly or in combination, is seen to describe the instant invention as claimed. Thus, a precast concrete pipe lifter apparatus solving the aforementioned problems is desired.

SUMMARY OF THE INVENTION

The invention is a precast concrete pipe lifter made up of a solid stabilizing plate over cooperating tongs, the base of the plate being capable of rotating about an axis parallel to the central axis of the pipe, thus providing rotational stability and versatility. The pipe lifter has reinforced linkage members, and multiple ribs between tong pairs, as well as multiple sets of cooperating tong pairs; thus the lifter is capable of withstanding tremendous torsional forces while safely navigating the piping into even very narrow trenches. There is also a one-piece handle/latch assembly that a helper may operate safely, i.e., while maintaining a distance from any potential pinch points.

Accordingly, it is a principal object of the invention to provide a pipe lifter having reinforced linkage members, multiple ribs between tong pairs, as well as multiple sets of cooperating tong pairs, so as to be capable of withstanding tremendous torsional forces while safely navigating the piping into trenches having diameters marginally larger than that of the piping.

It is another object of the invention to provide a pipe lifter having a solid stabilizing plate above cooperating pairs of tongs, such that the base of the plate is capable of rotating about an axis parallel to the central axis of the pipe, thus providing rotational stability and versatility.

It is another object of the invention to provide a pipe lifter having a one-piece handle/latch assembly that a helper may operate safely, i.e., while maintaining a distance from any potential pinch points.

It is a further object of the invention to provide a pipe lifter having a one-piece handle/latch assembly which serves the following multiple functions: as a guide, since the handle component may be used by a helper to guide the tong to a subject pipe; as a mechanical lever to disengage the latch from the catch pin so that the jaws of the tongs can freely clamp against the pipe; and, because of the handle arm's variable orientation with respect to the link members, the arm and handle of the assembly serves as an indicator, to signal to the crane operator to begin the lift.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
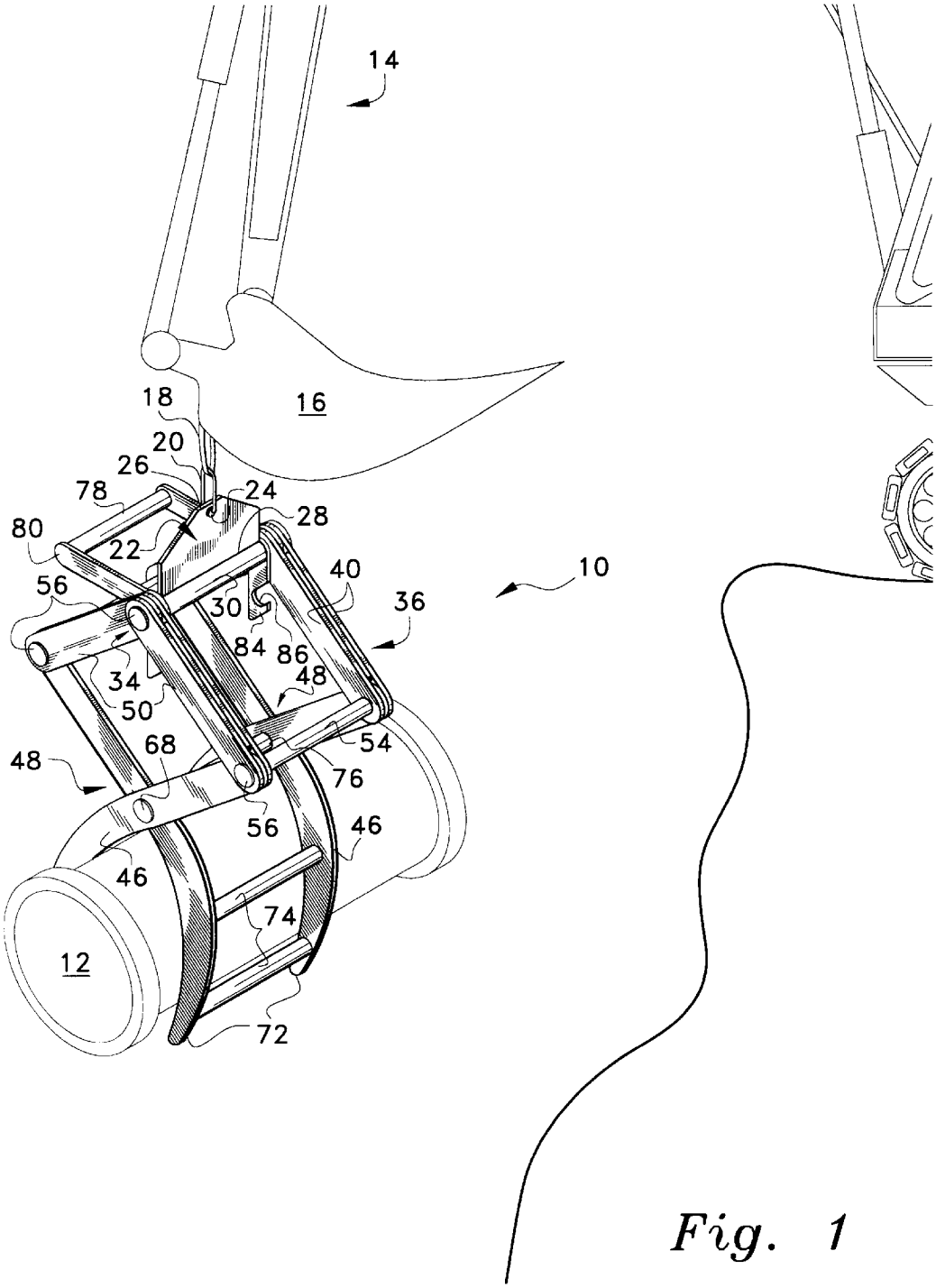
FIG. 1 is an environmental, perspective view of a concrete pipe lifter apparatus according to the present invention.

The present invention is a precast concrete pipe lifter apparatus 10 shown in FIG. 1 in its operational environment. lifting pipe 12. The invention can best be described beginning with crane arm 14 and the bucket 16 to which is attached a strong flexible sling 18, typically provided by the crane operator. Suspended from the metal sling 18, preferably a chain, is a locking metal clevis 20 of a U-shaped construction.

Suspended from the clevis 20 is a solid steel plate 22 symmetric about a central vertical axis. At the center of the upper end of the plate 22 is an aperture 24 for the clevis 20. In the preferred embodiment, the plate 22 has the shape of an isosceles trapezoid. The plate 22 has a short top edge 26 proximate to the aperture 24, and a long bottom edge 28 parallel to the top edge 26. Integral to bottom edge 28 is a steel tube 30 extending the length of the bottom edge 28. Tube 30 has two open ends 32, as shown more clearly in FIG. 3.

Figure 3:
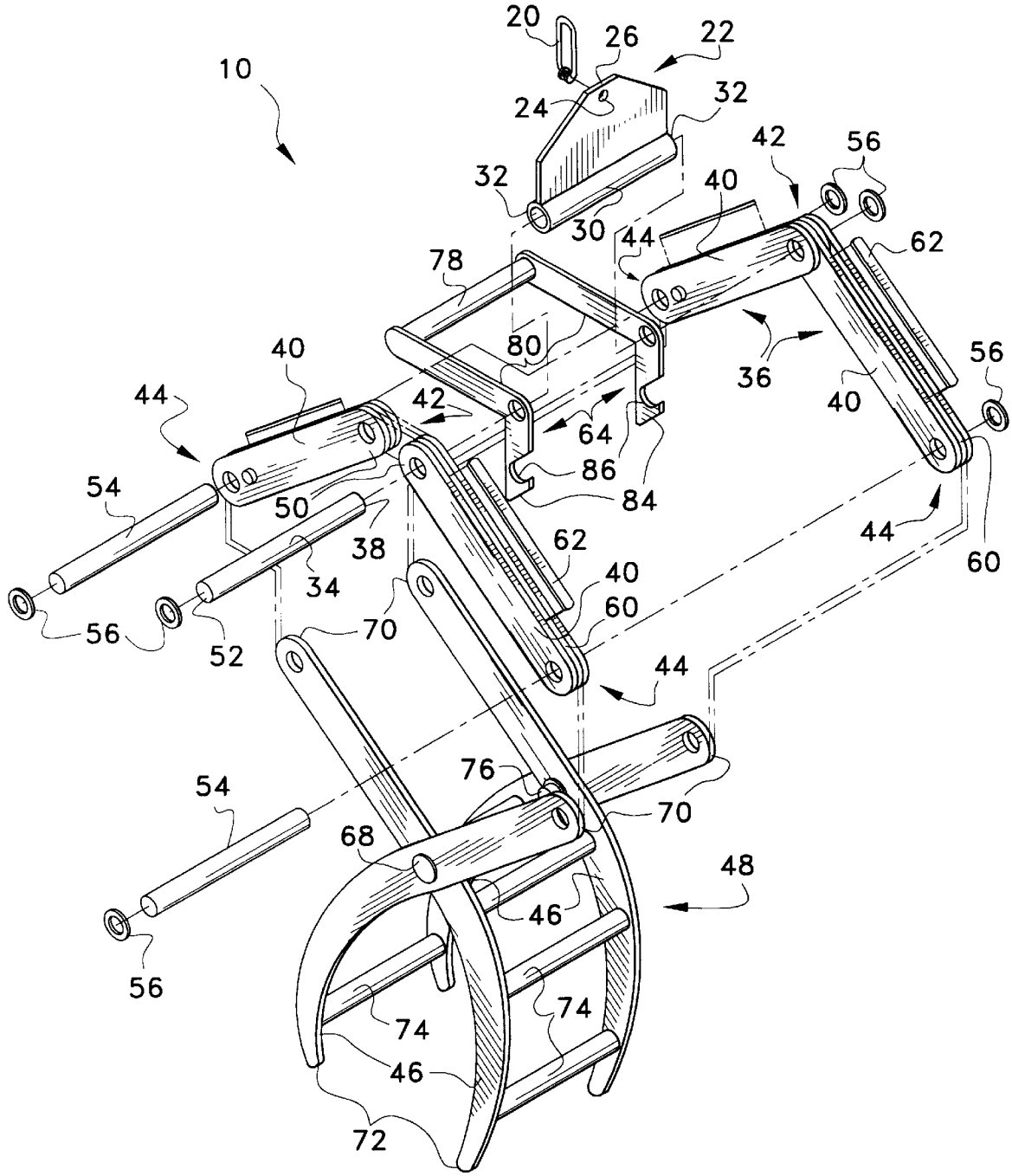
FIG. 3 is an exploded view showing the individual components of the pipe lifter apparatus.

As shown in FIG. 3, a solid steel axle 34 is slidably receivable into tube 30. Axle 34 is of a length such that it extends a short distance beyond each open end 32 of tube 30.

Figure 2:
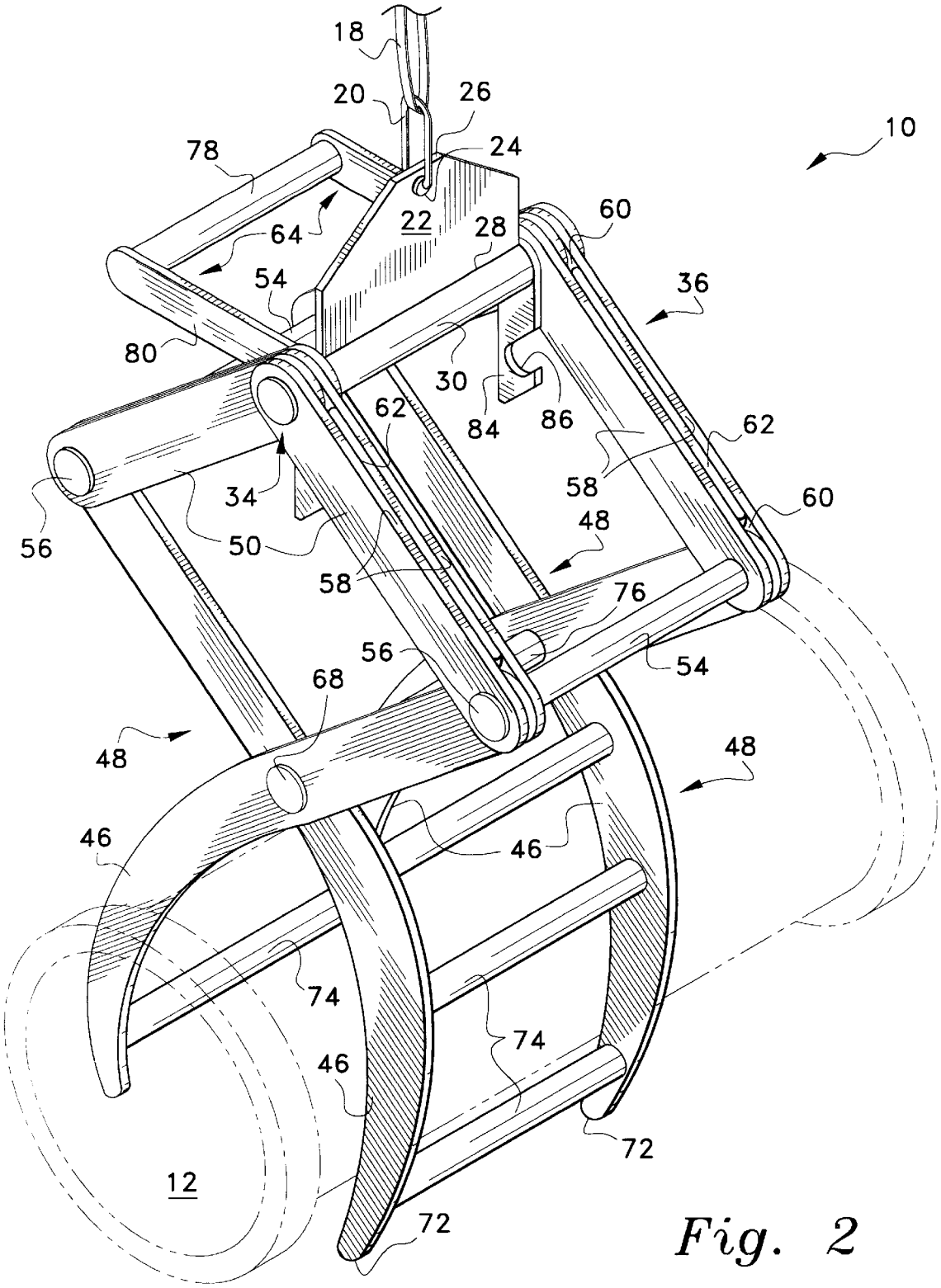
FIG. 2 is an enlarged perspective view of the pipe lifter apparatus detailing its components with a concrete pipe in shadow.

Rotatably attached to the ends of axle 34 is a first pair of link members 36 provided at a first end 38 of axle 34. FIG. 3 shows each individual link member 40. Each link member 40 of the first pair of link members 36 has an upper end 42 having a coincident pivot point on axle 34. Each link member 40 also has a lower end 44 rotatably joined to a tine or jaw 46 of a tong 48;

As best shown in FIG. 2, a second pair of link members 50 is provided at a second end 52 of the axle 34. Each member of the second pair of link members 50 has an upper end 42 having a coincident pivot point on axle 34, and a lower end 44 rotatably joined to a tine or jaw 46 of the tong 48. Rods 54 connect the lower ends of link member pairs 36 and 50. Rods 54 and the axle 34 are locked in by welded washers 56.

In the preferred embodiment, as shown in FIGS. 2, 3, 4, and 5, each link member 36 (as well as 50) is comprised of two parallel plates or arms 58, separated by a distance 60 slightly greater than the width of each parallel arm 58. As shown in FIG. 3, arms 58 are joined in spaced opposition by a welded plate 62.

A pair of one-piece handle/latch assemblies 64 (FIG. 3) is rotatably mounted at opposite ends of axle 34, inside of the link member pairs 36 and 50. Assembly 64, in its non-operatives position, rests upon a handle stop pin 66, shown in FIG. 5, protruding from an inside edge of the lower end 44 of the first pair of link members 36. Another handle stop pin (hidden), opposite stop 66, on the second pair of link members 50, is provided to support the opposite side of assembly 64.

Figure 4:
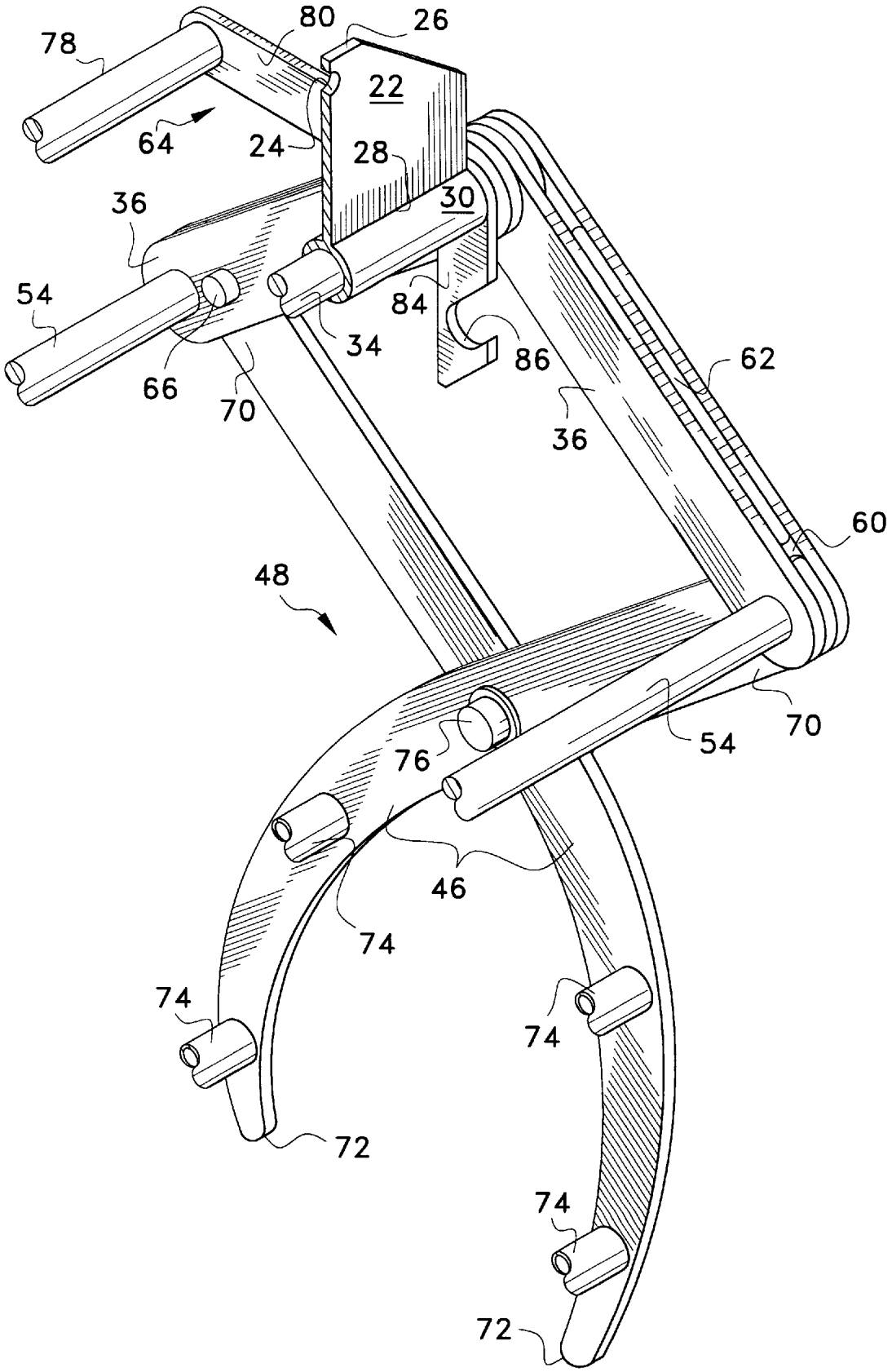
FIG. 4 is a perspective view showing an irregular vertical cut of the pipe lifter in its extended clamping position to show the latch catch, the handle stop, the hollow structural ribs, and the tube surrounding the axle.

The pairs of linking members 36 and 50 act as levers upon, and are linked at their lower ends 44 to tongs 48. By our definition, a tong 48 is comprised of two tines or jaws 46 having a common pivot pin 68 which is integral with the handle stop pin 66. As shown in FIG. 4, tongs 48 have link ends 70 connected to pairs of link members 36, 50, and a jaw end 72 opposite said link end 70. The jaw end 72 is capable of capturing and suspending a concrete pipe 12 as an upward force, i.e., by a crane, is applied to the link members 36, 50 along a vertical axis of symmetry. Referring back to FIG. 1, as a crane arm 14 lowers the pipe lifter 10 and a pipe 12 to the ground, compressive forces cause the link pairs 36 and 50 as well as the tongs 48 to collapse, thereby releasing the concrete pipe 12.

Figure 5:
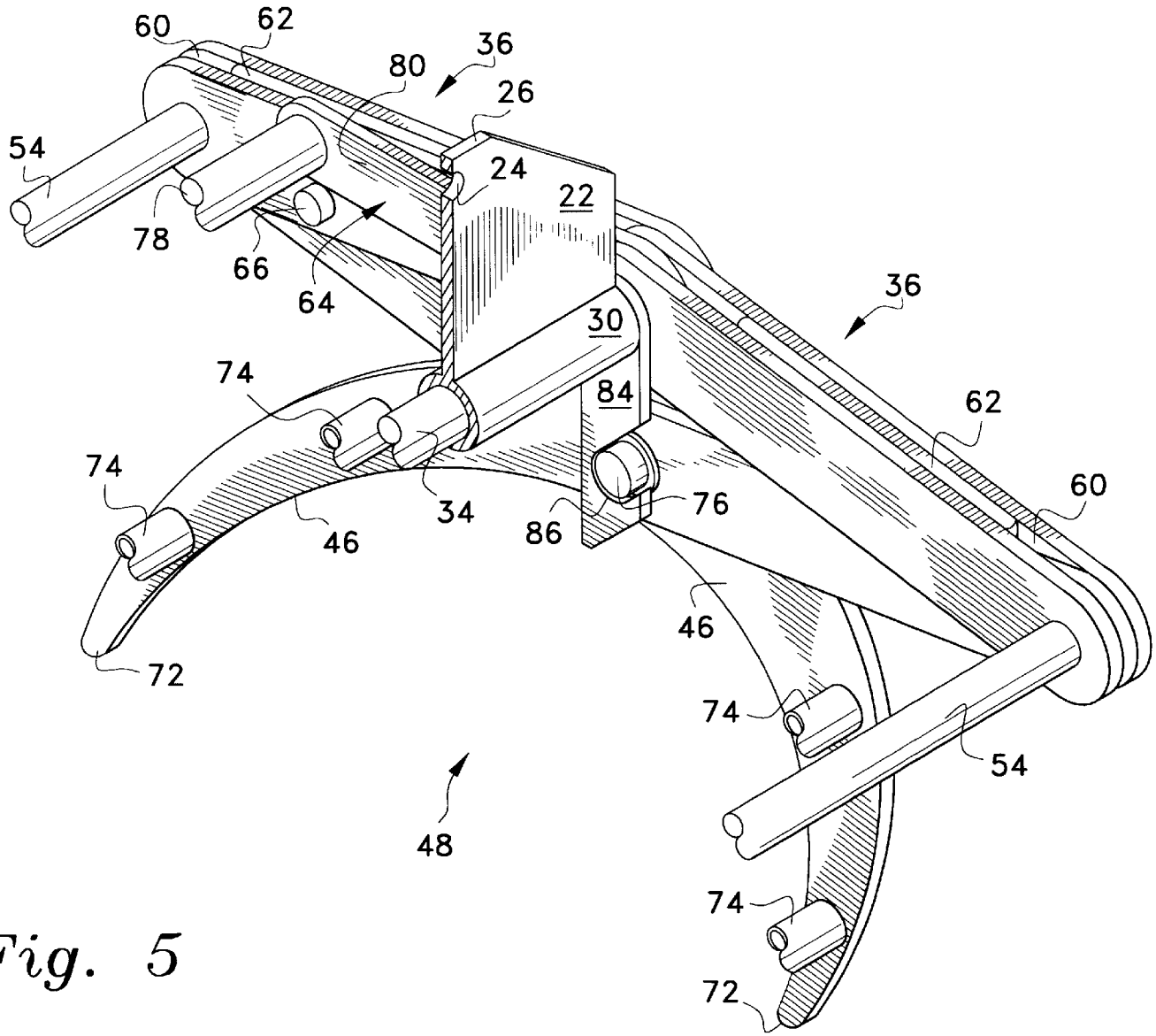
FIG. 5 is a perspective view showing an irregular vertical cut of the pipe lifter apparatus in its collapsed position, showing the latch catch engaged with the notch of the minor segment of the lever/latch such that the pipe lifter is disengaged from the subject pipe.

Critical to the strength and torsion resistance of the pipe lifter apparatus 10, a plurality of structural ribs 74 are provided. Three ribs appear in FIGS. 2 and 3 and extend between the tines or jaws 46 or in sum six ribs 74 per tongs 48. In FIGS. 1, 4 and 5, only two ribs 74 are depicted between a set of tines or jaws 46 or in sum four ribs 74 per tongs 48. The number of ribs 74 required would depend on the size of the tongs 48.

The handle/latch assembly 64 is designed to latch at each of two ends to a catch pin 76 which is also a pivot pin for the tongs 48, such that the handle/latch assemblies 64 can simultaneously engage catch pins 76 to hold open the tines 46 of the tongs 48.

In the locked open position shown in FIG. 5, one of the pair of handle/latch assemblies 64 has a handle 78 partially shown with the long leg or major segment 80 of the L-shaped lever/latch member 82 resting on the handle stop pin 66. Perpendicular to the long leg 80 is a short leg or minor segment 84 having a hook or notch 86 which engages the catch (and pivot) pin 76.

Figure 6:
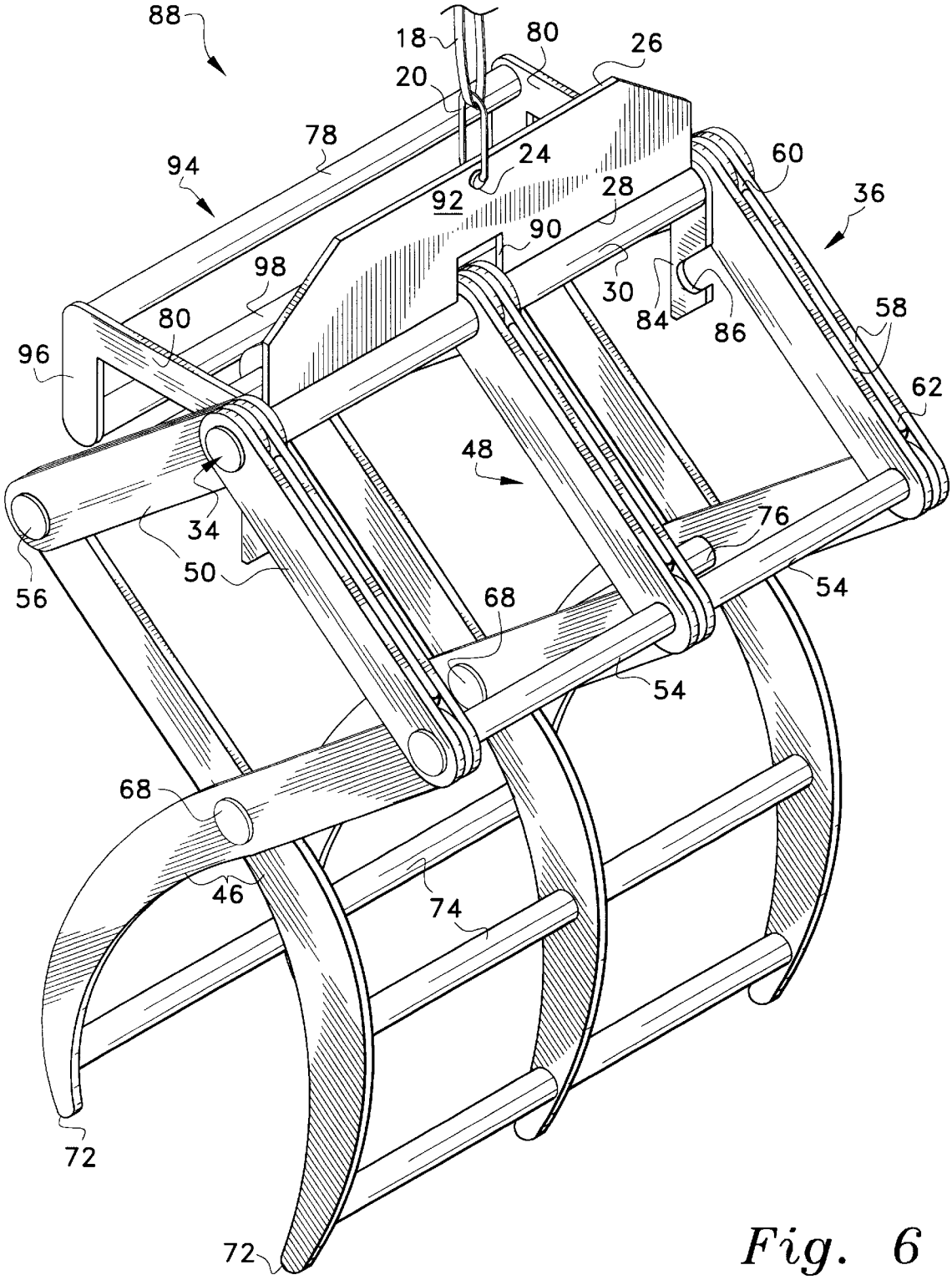
FIG. 6 is a perspective view of a second embodiment showing a three-tong apparatus including the handle extension, a slightly modified plate, and an added middle tong and corresponding link segment.

A second embodiment apparatus 88 illustrated in FIG. 6 shows a third tongs 48 disposed at the center of the axle 34 and housed within an open central portion 90 of the tube 30 and plate 92. As to other structural features, at least six ribs 74 between tongs 48 is preferred for the three-tonged embodiment 88. Moreover, the three-tonged embodiment 88 envisions a sizably larger pipe lifting apparatus such that it would be difficult for a helper to reach the handle 78 of the handle/latch assembly 94 because of its height from the ground. Therefore, included in the second embodiment 88 is a perpendicular handle extension 96 added to each end of long leg 80 of the handle/latch assembly 94 to incorporate another handle 98.

The preferred method of operating both embodiments 10, 88 of the pipe lifter includes grasping the handle 78, 98 of the handle/latch assembly 64, 94 to guide the pipe lifter apparatus 10, 88 to a pipe 12 as a crane lowers the pipe lifter apparatus. As the pipe lifter apparatus 10, 88 hits the ground, it collapses on itself, aided by the heavy plate 22, 92 causing both ends of the lever/latch assembly 64, 94 to engage the latch and pivot pin 68 along the inner sides of the outside tongs 48. After maneuvering the pipe lifter 10, 88 onto a pipe 12, a helper can then push up on the handle 78, 92 to release the latch or hook 86. The handle 78, 98 is useful to the crane operator because when the handle is up, it serves as a visual indicator that the latch assembly 64, 94 is unlatched, and that the pipe lifter 10, 88 is ready to clamp and lift the pipe 12.

It is to be understood that the present invention is not limited to the embodiments described above, but encompasses any and all embodiments within the scope of the following claims.

I claim:

1. A concrete pipe lifter apparatus comprising:

a flexible member supporting a clevis;

a plate symmetric about a central vertical axis suspended from said clevis by an aperture in said plate's axis of symmetry, said plate further comprising:

a top edge proximate to said aperture;

a bottom edge, parallel to said top edge, said bottom edge having integrally formed therein a hollow tube extending the length of said bottom edge, said tube having two open ends;

a solid axle slidably receivable into said tube, said axle having a length such that when said axle is received into said tube, said axle extends a short distance beyond each open end of said tube;

a first pair of link members provided at a first end of said axle, each member of said first pair of said link members further comprising:

an upper end having a coincident pivot point on said axle;

a lower end rotatably joined to a tine of a tong;

a second pair of link members provided at a second end of said axle, each member of said second pair of said link members further comprising:

an upper end having a coincident pivot point on said axle;

a lower end rotatably joined to a tine of a tong;

a rod connecting each said lower end of each said pair of link members to each lower end of each adjacent said pair of link members;

a one-piece handle/latch assembly rotatably mounted at each opposite end of said axle;

a first handle stop protruding from an inside edge of said lower end of said first pair of said link members;

a second handle stop protruding from an inside edge of said lower end of said second pair of said link members;

a first tong linked to said lower ends of said first pair of said link members, said first tong further comprising: two tines having a common pivot point;

a link end connected to a pair of link members;

a jaw end opposite said link end, said jaw end capable of capturing, suspending, and releasing a concrete pipe;

a second tong, identical to said first tong, linked to said lower ends of said second pair of said link members;

a plurality of structural ribs extending from said first tong to said second tong;

a first catch pin through the pivot point of said first tong; and a second catch pin through the pivot point of said second tong;

whereby said handle/latch assembly can simultaneously engage said first catch pin and said second catch pin to thereby hold open said jaw ends of said tongs.

2. The pipe lifter apparatus according to claim 1, including washers welded to the ends of said axle and said rods.

3. The pipe lifter apparatus according to claim 1, wherein said plate has the shape of an isosceles trapezoid.

4. The pipe lifter apparatus according to claim 1, wherein each said link member of each said pair of link members is comprised of two parallel plates separated by a distance slightly greater than the width of each of said parallel plates, said parallel plates joined in spaced opposition by a weld plate.

5. The pipe lifter apparatus according to claim 1, wherein a sling and a locking clevis suspended from said sling is attached to said aperture of said plate.

6. The pipe lifter apparatus according to claim 5, wherein the pipe lifter apparatus is made entirely of steel.

7. The pipe lifter apparatus according to claim 1, wherein said plurality of structural ribs is four.

8. The pipe lifter apparatus according to claim 1, wherein said plurality of structural ribs is six.

9. The pipe lifter apparatus according to claim 1, wherein said one-piece handle/latch assembly further comprises:

a handle having a first end proximate to said lower end of one member of said first pair of said link members, and a second end proximate to said lower end of one member of said second pair of said link members;

a first L-shaped lever/latch rigidly connected to said first end of said handle, said first L-shaped lever/latch further comprising:

a major segment substantially parallel to one member of said first pair of said link members, said major segment resting upon said handle stop;

a minor segment substantially perpendicular to said major segment, said minor segment comprising:

a hook capable of receiving said latch catch;

a pivot point at the intersection of said major segment and said minor segment about which said handle/latch assembly can rotate on said axle; and a second L-shaped lever/latch rigidly connected to said second end of said handle, said second L-shaped lever/latch symmetric to said first L-shaped lever/latch.

10. A concrete pipe lifter apparatus comprising:

a sling;

a locking clevis suspended from said sling;

a plate symmetric about a central vertical axis suspended from said clevis by a single penetration along said plate's axis of symmetry, said plate further comprising:

a top edge proximate to said penetration;

a bottom edge substantially parallel to said top edge, said bottom edge having integrally formed therein a hollow tube extending the length of said bottom edge, said tube having two open ends and an open central portion;

a solid axle slidably receivable into said tube, said axle having a length such that when said axle is received into said tube, said axle extends a short distance beyond each open end of said tube;

a first pair of link members provided at a first end of said axle, each member of said first pair of said link members further comprising:

an upper end having a coincident pivot point on said axle;

a lower end rotatably joined to a tine of a tong;

a second pair of link members provided at a second end of said axle, each member of said second pair of said link members further comprising:

an upper end having a coincident pivot point on said axle;

a lower end rotatably joined to a tine of a tong;

a third pair of link members disposed half way between said first end and said second end of said axle, said third pair housed within said open central portion of said tube, each member of said third pair of said link members further comprising:

an upper end having a coincident pivot point on said axle;

a lower end rotatably joined to a tine of a tong;

a rod connecting each said lower end of each said pair of link members to each lower end of each adjacent said pair of link members;

a one-piece handle/latch assembly rotatably mounted on opposite ends of said axle;

a first handle stop protruding from an inside edge of said lower end of said first pair of said link members;

a second handle stop protruding from an inside edge of said lower end of said second pair of said link members;

a first tong linked to said lower ends of said first pair of said link members, said first tong further comprising:

two tines having a common pivot point;

a link end connected to a pair of link members;

a jaw end opposite said link end, said jaw end capable of capturing, suspending, and releasing a concrete pipe;

a second tong, identical to said first tong, linked to said lower ends of said second pair of said link members;

a third tong identical to said first tong linked to said lower ends of said third pair of said link members;

a plurality of structural ribs extending from said first tong to said third tong;

a plurality of structural ribs extending from said third tong to said second tong;

a first catch pin through the pivot point of said first tong; and a second catch pin through the pivot point of said second tong;

whereby said handle/latch assembly can simultaneously engage said first catch pin and said second catch pin to thereby hold open said jaw ends of said tongs.

11. The pipe lifter apparatus according to claim 10, wherein said plate has the shape of an isosceles trapezoid having a central notch carved from a major base of said trapezoid.

12. The pipe lifter apparatus according to claim 10, wherein each said member of each said pair of link members is comprised of two parallel plates separated by a distance slightly greater than the width of each of said parallel plates, said parallel plates joined in spaced opposition by a weld plate.

13. The pipe lifter apparatus according to claim 10, wherein said plurality of structural ribs is at least six.

14. The pipe lifter apparatus according to claim 10, wherein the pipe lifter apparatus is made entirely of steel.

15. The pipe lifter apparatus according to claim 10, wherein said one-piece handle/latch assembly further comprises:

a handle having a first end proximate to said lower end of one member of said first pair of said link members, a second end proximate to said lower end of one member of said second pair of said link members;

a first L-shaped lever/latch rigidly connected to said first end of said handle, said first L-shaped lever/latch further comprising:

a major segment substantially parallel to one member of said first pair of said link members, said major segment resting upon said handle stop;

a minor segment substantially perpendicular to said major segment, said minor segment having a hook capable of receiving said latch catch;

a pivot point at the intersection of said major segment and said minor segment through which said handle/latch assembly can rotate about said axle;

a second L-shaped lever/latch rigidly connected to said second end of said handle, said second L-shaped lever/latch symmetric to said first L-shaped lever/latch; and a handle extension attached to said handle, said extension extending in a direction parallel to said handle;

whereby a worker can readily grasp the handle extension to collapse the tongs and release the concrete pipe.

* * * * *